US005720606A

United States Patent [19]

Pfefferle

[11] Patent Number: 5,720,606

[45] Date of Patent: Feb. 24, 1998

[54] CATALYTIC METHOD

[76] Inventor: William C. Pfefferle, 51 Woodland Dr., Middletown, N.J. 07748

[21] Appl. No.: 764,456

[22] Filed: Dec. 12, 1996

Related U.S. Application Data

[60] Division of Ser. No. 197,931, Feb. 17, 1994, Pat. No. 5,593,299, which is a continuation-in-part of Ser. No. 22,767, Feb. 25, 1993, abandoned, which is a continuation of Ser. No. 639,012, Jan. 9, 1991, abandoned.

[51] Int. Cl.[6] ..... F02M 27/02

[52] U.S. Cl. ..... 431/7; 431/326; 431/115

[58] Field of Search ..... 431/115, 116, 431/170, 326, 327, 329, 353, 7, 155; 60/723

[56] References Cited

U.S. PATENT DOCUMENTS

| | | | |
|---|---|---|---|
| 4,197,701 | 4/1980 | Boyum | 431/7 |
| 4,204,829 | 5/1980 | Kendall et al. | 431/7 |
| 4,459,126 | 7/1984 | Krill et al. | 431/7 |
| 4,870,824 | 10/1989 | Young et al. | 431/7 |
| 5,202,303 | 4/1993 | Dalla Betta et al. | 431/7 |

FOREIGN PATENT DOCUMENTS

| | | | |
|---|---|---|---|
| 59-136140 | 8/1984 | Japan | 431/7 |
| 61-259013 | 11/1996 | Japan | 431/268 |

*Primary Examiner*—Carl D. Price
*Attorney, Agent, or Firm*—Kane, Dalsimer, Sullivan, Kurucz, Levy, Eisele and Richard

[57] ABSTRACT

The method of combusting lean fuel-air mixtures comprising the steps of:

a. obtaining a gaseous admixture of fuel and air, said admixture having an adiabatic flame temperature below a temperature which would result in any substantial formation of nitrogen oxides but above about 800° Kelvin, b. contacting at least a portion of said admixture with a catalytic surface and producing reaction products, c. passing said reaction products to a thermal reaction chamber, thereby igniting and stabilizing combustion in said thermal reaction chamber.

3 Claims, 2 Drawing Sheets

CATALYTIC METHOD

CROSS-REFERENCE TO RELATED APPLICATION

This application is a Division of our U.S. patent application Ser. No. 08/197,931 filed Feb. 17, 1994, now issued as U.S. Pat. No. 5,593,299 and which was a Continuation-In-Part application of my U.S. patent application Ser. No. 08/22,767 filed Feb. 25, 1993, now abandoned, and which was a Continuation of my U.S. application Ser. No. 639,012 filed Jan. 9, 1991 and now abandoned.

BACKGROUND OF THE INVENTION

1. Field of the Invention

This invention relates to improved systems for combustion of fuels and to methods for catalytic promotion of fuel combustion. In one specific aspect the present invention relates to low thermal emissions combustors for gas turbine applications.

2. Brief Description of the Prior Art

Gas turbine combustors require the capability for good combustion stability over a wide range of operating conditions. To achieve low $NO_x$ operation with variations of conventional combustors has required operating so close to the stability limit that not only is turndown compromised, but combustion stability as well. Although emissions can be controlled by use of the catalytic combustors of my U.S. Pat. No. 3,928,961, such combustors typically also have a much lower turndown ratio than conventional combustors with efficient operation limited to temperatures above about 1400 Kelvin with an upper temperature limited not only by $NO_x$ formation kinetics but by catalyst materials survivability, thus limiting use in some applications.

The present invention meets the need for reduced emissions by providing a system for the combustion of fuel lean fuel-air mixtures, even those having exceptionally low adiabatic flame temperatures.

SUMMARY OF THE INVENTION

Definition of Terms

In the present invention the terms "monolith" and "monolith catalyst" refer not only to conventional monolithic structures and catalysts such as employed in conventional catalytic converters but also to any equivalent unitary structure such as an assembly or roll of interlocking sheets or the like.

The terms "Microlith™" and "Microlith™ catalyst" refer to high open area monolith catalyst elements with flow paths so short that reaction rate per unit length per channel is at least fifty percent higher than for the same diameter channel with a fully developed boundary layer in laminar flow, i.e. a flow path of less than about two mm in length, preferably less than one mm or even less than 0.5 mm and having flow channels with a ratio of channel flow length to channel diameter less than about two to one, but preferably less than one to one and more preferably less than about 0.5 to one. Channel diameter is defined as the diameter of the largest circle which will fit within the given flow channel and is preferably less than one mm or more preferably less than 0.5 mm.

The terms "fuel" and "hydrocarbon" as used in the present invention not only refer to organic compounds, including conventional liquid and gaseous fuels, but also to gas streams containing fuel values in the form of compounds such as carbon monoxide, organic compounds or partial oxidation products of carbon containing compounds.

The Invention

It has now been found that gas phase combustion of prevaporized very lean fuel-air mixtures can be stabilized by use of a catalyst at temperatures as low as 1000 or even below 900 degrees. Kelvin, far below mot only the minimum flame temperatures of conventional combustion systems but even below the minimum combustion temperatures required for the catalytic combustion method of my earlier systems described in U.S. Pat. No. 3,928,961.

Thus, the present invention makes possible practical ultra low emissions catalytic combustors. Equally important, the low minimum operating temperatures of the method of this invention make possible catalytically stabilized combustors for gas turbines, having a large turndown ratio without the use of variable geometry and often even the need for dilution air to achieve the low turbine inlet temperatures required for idle and low power operation.

In the method of the present invention, a fuel-air mixture is contacted with an ignition source to produce heat and reactive intermediates for continuous stabilization of combustion in a thermal reaction zone at temperatures not only well below a temperature resulting in significant formation of nitrogen oxides from molecular nitrogen and oxygen but even below the minimum temperatures of prior art catalytic combustors. Combustion can be stabilized in the thermal reaction zone even at temperatures as low as 1000° Kelvin or below. Catalytic surfaces have been found to be especially effective for ignition of such fuel-air mixtures. The efficient, rapid thermal combustion which occurs in the presence of a catalyst, even with lean fuel-air mixtures outside the normal flammable limits, is believed to result from the injection of heat and free radicals produced by the catalyst surface reactions at a rate sufficient to counter the quenching of free radicals which otherwise minimize thermal reaction even at combustion temperatures much higher than those feasible in the method of the present invention. The catalyst may be in the form of a Microlith™, a microlith or even a combustion wall coating, the latter allowing higher maximum operating temperatures than might be tolerated by a catalyst operating at or close to the adiabatic combustion temperature. Advantageously, in many applications the thermal reaction zone is well mixed. Plug flow operation is possible provided the thermal zone inlet temperature is above the spontaneous ignition temperature of the given fuel, typically less than about 700° Kelvin for most fuels but around 900° Kelvin for methane and about 750° Kelvin for ethane.

In one embodiment of the present invention, a fuel-air mixture is contacted with an ignition source to produce combustion products, at least a portion of which are mixed with a fuel-air mixture in a well mixed thermal reaction zone.

In a specific embodiment of the present invention which is particularly suited to small gasoline engine exhaust clean-up, engine exhaust gas is mixed with air in sufficient quantity to consume at least a major portion of the combustibles present and passed to a recirculating flow in a thermal reaction zone. Effluent from the thermal zone exits through a monolithic catalyst, preferably a Microlith™. Pulsation of the exhaust flow draws sufficient reaction products from contact with the catalyst back into the thermal zone to ignite and stabilize gas phase combustion in the thermal zone. Typically, engine exhaust temperature is high enough to achieve thermal combustion light-off within seconds of engine starting, especially with use of low thermal mass Microlith™ igniter catalysts. Hot combustion gases exiting the thermal reaction zone contact the catalyst providing enhanced conversion, particularly at marginal temperature levels for thermal reaction. Alternatively, the catalyst may be placed at the reactor inlet, as typically would be the case for furnace combustors, or even applied as a coating to the thermal zone walls in a manner such as to contact recirculating gases. Wall coated catalysts are especially effective with fuel-air mixtures at thermal reaction zone inlet temperatures in excess of about 700° Kelvin such as is often the case with exhaust gases from internal combustion engines.

For combustors, placement of the catalyst at the inlet to the thermal reaction zone allows operation of the catalyst at a temperature below that of the thermal combustion region. Such placement permits operation of the combustor at temperatures well above the temperature of the catalyst as is the case for a combustor wall coated catalyst. Use of electrically heatable catalysts provides both ease of light-off and ready relight in case of a flameout. This also permits use of less costly catalyst materials inasmuch as the lowest possible light-off temperature is not required with an electrically heated catalyst. With typical aviation gas turbines, near instantaneous light-off of combustion is important. This is especially true of auxiliary power units which must be started in flight, typically at high altitude low temperature conditions. Thus use of electrically heatable "Microlith™" catalysts are often desireable. To minimize light-off power requirements, only a portion of the inlet flow need be passed through the electrically heated catalyst for reliable ignition of combustion in the thermal reaction zone. With sufficiently high inlet air temperatures, typically at least about 600° Kelvin with most fuels, plug flow operation of the thermal reaction zone is possible even at adiabatic flame temperatures as low as 800° or 900° Kelvin.

The mass of Microlith™ catalyst elements can be so low that it is feasible to electrically preheat the catalyst to an effective operating temperature in less than about 0.50 seconds. In the catalytic combustor applications of this invention the low thermal mass of "Microlith™" catalysts makes it possible to bring an electrically conductive combustor catalyst up to a light-off temperature as high as 1000 or even 1500 degrees Kelvin or more in less than about five seconds, often in less than about one or two seconds with modest power useage. Such rapid heating is allowable for Microlith™ catalysts because sufficiently short flow paths permit rapid heating without destructive stresses from consequent thermal expansion.

Typically, in both automotive exhaust and gas turbine combustor systems of the present invention the Microlith™ catalyst elements preferably have an open area in the direction of flow of at least about 65%, and more preferably at least about 70%. However, lower open area catalysts may be desireable for low flow placements and use of wall coated catalysts are especially advantageous in certain applications.

In those catalytic combustor applications where unvaporized fuel droplets may be present, flow channel diameter should preferably be large enough to allow unrestricted passage of the largest expected fuel droplet. Therefore in catalytic combustor applications flow channels may be as large as 1.0 millimeters in diameter or more. For combustors, operation with fuel droplets entering the catalyst allows plug flow operation in a downsteam thermal combustion zone even at the very low temperatures otherwise achievable only in a well mixed thermal reaction zone.

Although use of Microlith™ or other monolith catalysts offers unique capabilities, wall coated catalysts offer not only very high maximum operating temperatures but very low pressure drop capabilities. No obstruction in the flow path is required. Thus, wall coated catalysts are especially advantageous for very high flow velocity combustors and particularly at supersonic flow velocities.

DETAILED DESCRIPTION OF THE INVENTION AND PREFERRED EMBODIMENTS

Figure 1:
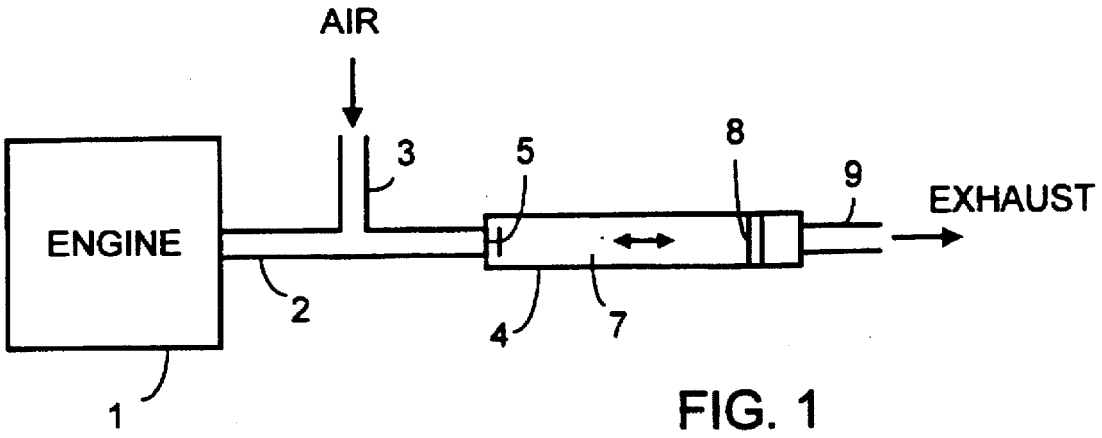
FIG. 1 shows a schematic of a catalytically induced and stabilized thermal reaction system for reduction of pollutants from a single cylinder gasoline engine.
Figure 2:
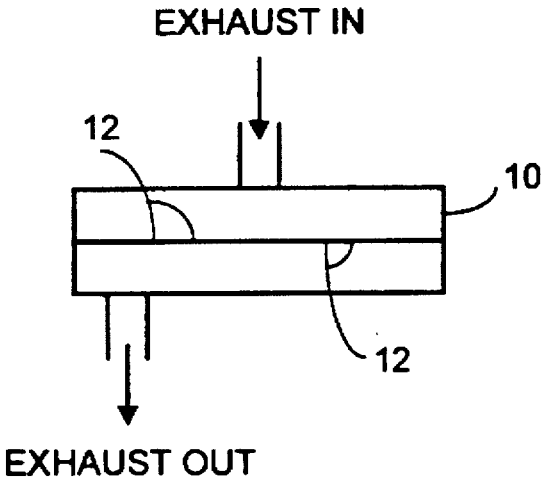
FIG. 2 shows a catalytically stabilized thermal reaction muffler in which thermal reaction is promoted by catalyst coatings.

The present invention is further described in connection with the drawings. As shown in FIG. 1, in one preferred embodiment the exhaust from a single cylinder gasoline engine 1 passes through exhaust line 2 into which is injected air through line 3. The exhaust gas and the added air pass from line 2 into vessel 4 where swirler 5 creates strong recirculation in thermal reaction zone 7. Gases exiting vessel 4 pass through catalytic element 8 into vent line 9. Reactions occurring on catalyst 8 ignite and stabilize gas phase combustion in reaction zone 7 resulting in very low emissions of carbonaceous pollutants. Gas phase reaction is stabilized even at temperatures as low as 800° Kelvin. In FIG. 2, catalytic baffle plate surfaces 12 of exhaust muffler 10 promote gas phase thermal reactions in muffler 10.

Figure 3:
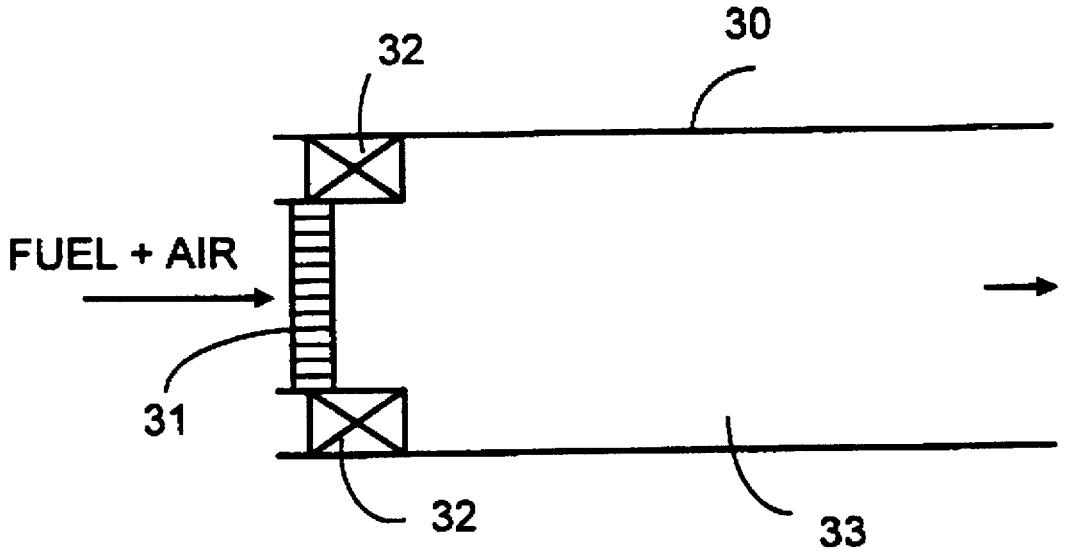
FIG. 3 shows a schematic of a high turn down ratio catalytically induced thermal reaction gas turbine combustor.

In FIG. 3, fuel and air are passed over electrically heated Microlith™ catalyst 31 mounted at the inlet of combustor 30 igniting gas phase combustion in thermal reaction zone 33. Swirler 32 induces gas recirculation in thermal reaction zone 33 allowing combustion effluent from catalyst 31 to promote efficient gas phase combustion of very lean prevaporized fuel-air mixtures in reaction zone 33. In the system of FIG. 3, efficient combustion of lean premised fuel-air mixtures not only can be stabilized at flame temperatures below a temperature which would result in any substantial formation of oxides of nitrogen but at adiabatic flame temperatures well below a temperature of 1200° Kelvin, and even as low as 900° Kelvin.

EXAMPLE I

Fuel rich exhaust gas from a small single cylinder gasoline powered spark ignition engine was passed into a thermal reactor through a swirler thereby inducing recirculation within the thermal reactor. The gases exiting the thermal reactor passed through a bed comprising ten Microlith™ catalyst elements having a platinum containing coating. Exhaust pulsations resulted in backflow surges through the catalyst back into the thermal reaction zone. Addition of sufficient air to the exhaust gases for combustion of the hydrocarbons and carbon monoxide in the hot 800° Kelvin exhaust gases before the exhaust gases entered the thermal reactor resulted in better than 90 percent destruction of the hydrocarbons present and a carbon monoxide concentration of less than 0.5 percent in the effluent from the thermal reactor entering the catalyst bed. The temperature rise in the thermal reactor was greater than 200° Kelvin.

EXAMPLE II

Using the same system as in Example I, tests were run in the absence of the Microlith™ catalyst bed. Addition of air to the hot exhaust gases yielded essentially no conversion of hydrocarbons or carbon monoxide. Reactor exit temperature was lower than the 800° Kelvin engine exhaust temperature.

EXAMPLE III

In place of the reaction system of Example I, tests were run with the same engine in which a coating of platinum metal catalyst was applied to the internal walls of the engine muffler with the muffler serving as a stirred thermal reactor. As in example I, addition of sufficient air for combustion resulted in stable thermal combustion. With sufficient air for complete combustion of all fuel values, the measured exhaust emissions as a function of engine load were:

| | Exit Temp. | HC, ppm | CO, % |
|---|---|---|---|
| idle | 800 K. | 80 | 0.5 |
| ½ load | 913 K. | 4 | 0.15 |
| full load | 903 K. | 4 | 0.15 |

EXAMPLE IV

Lean gas phase combustion of Jet-A fuel is stabilized by spraying the fuel into flowing air at a temperature of 750° Kelvin and passing the resulting fuel-air mixture through a platinum activated Microlith™ catalyst. The fuel-air mixture is ignited by contact with the catalyst, passed to a plug flow thermal reactor and reacts to produce carbon dioxide and water with release of heat. The catalyst typically operates at a temperature in the range of about 100 Kelvin or more lower than the adiabatic flame temperature of the inlet fuel-air mixture. Efficient combustion is obtained over range of temperatures as high 2000° Kelvin and as low as 1100° Kelvin, a turndown ratio higher than existing conventional gas turbine combustors and much higher than catalytic combustors. Premixed fuel and air may be added to he thermal reactor downstream of the catalyst to reduce the flow through the catalyst. If the added fuel-air mixture has an adiabatic flame temperature higher than that of the mixture contacting the catalyst, outlet temperatures at full load much higher than 2000° Kelvin can be obtained with operation of the catalyst maintained at a temperature lower than 1200° Kelvin.

What is claimed is:

1. A catalytically stabilized gas phase combustion system comprising:

a. a thermal reaction chamber having a chamber inlet and containing means for inducing effective circulation and mixing of gases flowing from the conduit and through said chamber;

b. continuous catalytic ignition surface means mounted in the chamber inlet for stabilizing lean gas phase combustion in said chamber at a combustion temperature below about 1400° Kelvin; and c. conduit means connected to the reaction chamber inlet for passing a lean admixture of fuel and air into the chamber for contact with said catalytic ignition means;

said catalytic ignition means comprising a monolithic catalyst element with flow paths so short that reaction rate per unit length per channel is at least fifty percent higher than for the same diameter channel with a fully developed boundary layer in laminar flow and an open area in the direction of flow greater than about 60 percent.

2. The system of claim 1 comprising heating control means to maintain said catalyst at an effective temperature.

3. The system of claim 1 wherein said catalytic surface comprises catalyst coated on a portion of said reaction chamber walls.

* * * * *